US007553383B2

(12) United States Patent
Shamblen et al.

(10) Patent No.: US 7,553,383 B2
(45) **Date of Patent: *Jun. 30, 2009**

(54) METHOD FOR FABRICATING A MARTENSITIC STEEL WITHOUT ANY MELTING

(75) Inventors: Clifford Earl Shamblen, Cincinnati, OH (US); Andrew Philip Woodfield, Cincinnati, OH (US); Eric Allen Ott, Cincinnati, OH (US); Michael Francis Xavier Gigliotti, Glenville, NY (US)

(73) Assignee: General Electric Company, Schenectady, NY (US)

( * ) Notice: Subject to any disclaimer, the term of this patent is extended or adjusted under 35 U.S.C. 154(b) by 1098 days.

This patent is subject to a terminal disclaimer.

(21) Appl. No.: 10/423,288

(22) Filed: Apr. 25, 2003

(65) Prior Publication Data

US 2004/0211293 A1 Oct. 28, 2004

(51) Int. Cl.
*C21C 7/00* (2006.01)

(52) U.S. Cl. ..... 148/579; 420/590

(58) Field of Classification Search ..... 419/31; 75/10.63, 351; 148/579; 420/590
See application file for complete search history.

(56) References Cited

U.S. PATENT DOCUMENTS

| | | | | |
|---|---|---|---|---|
| 3,206,338 | A * | 9/1965 | Miller et al. | 148/105 |
| 3,535,104 | A * | 10/1970 | Wolf et al. | 75/255 |
| 4,613,385 | A * | 9/1986 | Thomas et al. | 148/599 |
| 4,988,266 | A * | 1/1991 | Nakamura et al. | 415/173.1 |
| 5,130,207 | A * | 7/1992 | Nelson | 428/577 |
| 5,322,666 | A | 6/1994 | Watwe | |
| 5,415,706 | A * | 5/1995 | Scarlin et al. | 148/325 |
| 5,779,761 | A | 7/1998 | Armstrong et al. | |
| 5,930,580 | A | 7/1999 | Everett | |
| 5,958,106 | A | 9/1999 | Armstrong et al. | |
| 5,984,996 | A * | 11/1999 | Gonsalves et al. | 75/246 |
| 6,149,709 | A * | 11/2000 | Uragami et al. | 75/504 |
| 6,582,651 | B1 * | 6/2003 | Cochran et al. | 419/5 |
| 6,610,120 | B2 * | 8/2003 | Nakamura et al. | 75/255 |
| 2005/0220656 | A1 * | 10/2005 | Shamblen et al. | 419/34 |

FOREIGN PATENT DOCUMENTS

| | | | |
|---|---|---|---|
| JP | 57-164958 | * | 10/1982 |
| JP | 59-050151 | * | 3/1984 |
| WO | WO 9964638 | | 12/1999 |
| WO | WO 00/76698 A1 | | 12/2000 |

OTHER PUBLICATIONS

Brick et al., Structure and Properties of Engineering Materials, McGraw-Hill, 1977, p. 141-152.*

(Continued)

*Primary Examiner*—George Wyszomierski
*Assistant Examiner*—Tima M McGuthry-Banks
(74) *Attorney, Agent, or Firm*—McNees Wallace & Nurick, LLC

(57) ABSTRACT

A martensitic steel metallic article (20) made of metallic constituent elements is fabricated from a mixture of nonmetallic precursor compounds of the metallic constituent elements. The mixture of nonmetallic precursor compounds is chemically reduced to produce a metallic martensitic steel, without melting the metallic martensitic steel. The metallic martensitic steel is consolidated to produce a consolidated metallic article (20), without melting the metallic martensitic steel and without melting the consolidated metallic article (20).

16 Claims, 2 Drawing Sheets

OTHER PUBLICATIONS

Reed-Hill et al., Physical Metallurgy Principles, 3rd edition, PWS publishing, 1992, pp. 659-660.* http://www.key-to-steel.com/ViewArticle.asp?ID=155, printed from internet on Sep. 25, 2006.*

Metals Handbook, Desk Edition, 2nd edition, ASM, 1998, pp. 37 & 45.*

The Metals Handbook, Desk Edition, 2nd Edition, ASM International, p. 54.*

ASM Handbook, vol. 9, Metallorgaphy and Microstructures, ASM International, pp. 7 and 169-170.*

Webster's Seventh New Collegiate Dictionary, G. & C. Merriam Co., 1965, p. 200.*

Metals Handbook, Desk Edition, 2nd Edition, ASM International, 1998, p. 54.*

EngNet, Engineering Dictionary, Eutectorid Steel, printed from web on May 1, 2007.*

Derwnt Acc. No. 1995-080618 from RU 2,0144,882 C1. Published Jun. 15, 1994. Abstract.*

English translation of JP 57-164958, published Oct. 9, 1982. Toyoaki Ishibachi et al.*

Ishibachi, Toyoaki et al. Manufacturing Method for Sintered High-Alloy Steel. English translation of JP 57-164958 issued Oct. 9, 1982.*

ASM Handbook, vol. 9, Metallorgaphy and Microstructures, ASM International, pp. 7 and 169-170., Dec. 1985.*

Werner Schatt and Klaus-Peter Wieters: "Pulvermetallurgle", 1994, VDI Verlag, Germany, XP002290651.

* cited by examiner

METHOD FOR FABRICATING A MARTENSITIC STEEL WITHOUT ANY MELTING

This invention relates to the fabrication of a metallic martensitic steel composition and article using a procedure in which the martensitic steel is never melted.

BACKGROUND OF THE INVENTION

Martensitic steels are iron-base, steel alloys having a composition and given a heat treatment that produces a martensitic microstructure in the steel. The martensitic steels have wide application in the aircraft propulsion industry and are also used in other industries such as automotive. Metallic articles made of martensitic steels are fabricated by any of a number of techniques, as may be appropriate for the nature of the metal and the article. In one common approach, metal-containing ores are refined to produce molten metal, which is thereafter cast. Ore refinement may take place separately for each of the major alloying elements, or in combination for more than one element. Elements and combinations of elements may take many intermediate forms before being melted to form the final alloy. The metal is refined as necessary to remove or reduce the amounts of undesirable minor elements. The composition of the refined metal may also be modified by the addition of desirable alloying elements. These refining and alloying steps may be performed during the initial melting process or during remelting. After a martensitic steel of the desired composition is produced, it may be used in the as-cast form for some compositions (i.e. cast martensitic steels), or it may be cast and further worked to form the metal to the desired shape for other compositions (i.e. wrought martensitic). It may instead be atomized to form fine powder and subsequently consolidated and, in some cases, further worked (i.e. powder metallurgy martensitic steels). In any case, further processing such as heat treating, machining, surface coating, and the like may be employed.

Regardless of the processing route, all of these forms involve melt processing and are, as a result, subject to restrictions imposed by such processes. Melting of martensitic steels is typically accomplished using multiple melt processes for premium-quality material in order to refine undesirable residual element content, to homogenize the overall composition, and to adjust the alloy content; or by single-melt processes and subsequent ladle modifications for standard-quality material. In either case, the melt is cast to produce the final ingot or article. In multiple melt processes, intermediate cast electrodes are produced which serve as the input stock to the subsequent melting step. Melting processes include those which are not performed under vacuum such as electroslag remelting, air melting, basic-oxygen-furnace melting, open-hearth-furnace melting, and electric-arc-furnace melting followed by argon-oxygen decarburization, and those which are performed under vacuum such as vacuum induction melting, vacuum arc remelting, and vacuum oxygen decarburization. Non-vacuum processes require the use of refining and protecting slags during the melting process. In any case, additional chemistry modifications may take place in the ladle to refine impurity content and add additional alloying elements. Additional limitations are also imposed as a result of the melting process for martensitic steels because of their composition. Alloy composition and resulting segregation issues during solidification impose practical limits on the melting rate and the maximum electrode or ingot diameters which can be produced without gross imperfections. In order to reduce the incidence of melt-related imperfections, strict melt controls are imposed so as to monitor and control melt rate, heat input, melt temperature, electrode-to-crucible clearance, and other critical parameters. Inadequate control of these parameters can result in material with significant solidification-related defects which, in turn, can reduce yield and increase production costs. In melting procedures, such as vacuum induction melting and other processes, which require vessels with refractory linings, where one alloy is melted in the ceramic melt crucible, and then a second alloy of a different composition is to be subsequently melted in the same vessel, an intermediate "wash heat" maybe required in order to minimize alloying element contamination from one alloy to the next which may result from residual alloy material remaining on the crucible wall. This wash heat requirement adds to the overall cost of producing high-quality martensitic steel.

Imperfections may result from melting processes or as a result of subsequent forming operations. Melt-related imperfections include those related to segregation as well as those resulting from extrinsic contaminants such as air and crucible ceramics. Melting of martensitic steels is subject to significant solidification segregation that can result in the formation of imperfections such as freckles, eutectic nodules, white spots, and banding. Freckles are the result of alloying-element partitioning during solidification, and are most prevalent in those materials that are highly alloyed to achieve improved properties. White spots, likewise, are a result of alloying-element segregation, but can also be associated with extrinsic contamination from crucible ceramics or remnant slag inclusions (dirty white spots). Inclusions such as sulfides and carbosulfides may also form as a result of high sulfur contents in the melts. Nitrides, alumina, and calcium aluminates may also form. These melt-related imperfections can significantly degrade the fatigue resistance and/or toughness of the martensitic steel. Melt-related imperfections can also contribute to forging-related imperfections such as cracking. Some highly alloyed materials are also more difficult to form as a result of inheriting the coarse cast structure which can lead to additional forging-related imperfections.

Some martensitic steels are also produced using powder metallurgy processes to circumvent these segregation imperfection issues, particularly for large-diameter ingots, and to reduce the size of extrinsic contaminants resulting from the multiple melt process. The current powder metallurgy processes, however, require martensitic steel to first be melted to produce alloy ingot, and then remelted and atomized to produce powder. These powder metallurgy processes add great expense and can still result in extrinsic contamination from crucible ceramics and slag. In addition, powder metallurgy processes are subject to concerns related to inert gas entrapment in powder particles during the atomization process, which can lead to residual porosity in the resulting billet or component. These imperfections can degrade the fatigue and/or toughness properties of articles produced by the current powder metallurgy process.

As a result, melting processes impose significant limitations on the resulting article. Incremental performance improvements resulting from processing modifications and incremental improvements in production cost reduction are still possible in a number of areas. However, the present inventors have recognized in the work leading to the present invention that in other instances the fabrication approach involving multiple melt steps imposes fundamental performance limitations that cannot be overcome at any reasonable cost. They have recognized a need for a departure from the conventional thinking in fabrication technology which will overcome many of these fundamental limitations. The present invention fulfils this need, and further provides related advantages.

BRIEF SUMMARY OF THE INVENTION

The present invention provides a fabrication approach for metallic martensitic steel articles in which the metal is never melted. Prior fabrication techniques require melting the metal at some point in the processing. The melting operation, which often involves multiple melting and solidification steps, is costly and imposes some fundamental limitations on the properties of the final martensitic steel articles. In some cases, these fundamental limitations cannot be overcome, and in other cases they may be overcome only at great expense. The origin of many of these limitations may be traced directly to the fact of melting the martensitic steel at some point in the fabrication processing and the associated solidification from that melting. The present approach avoids these limitations entirely by not melting the martensitic steel at any point in the processing between a nonmetallic precursor form and the final metallic martensitic steel article.

A method for fabricating a metallic martensitic steel article made of metallic constituent elements comprises the steps of furnishing a mixture of nonmetallic precursor compounds of the metallic constituent elements, chemically reducing the mixture of nonmetallic precursor compounds to produce a metallic martensitic steel, without melting the metallic martensitic steel, and consolidating the metallic martensitic steel to produce a consolidated metallic martensitic steel article, without melting the metallic martensitic steel and without melting the consolidated metallic article. That is, the martensitic steel is never melted.

"Martensitic steel" as used herein is defined as having a composition of an iron-base alloy, wherein iron is present in an amount of at least about 50 percent by weight, which possesses a continuous body-centered cubic (BCC) or body-centered tetragonal (BCT) crystal structure matrix phase. At least about 75 percent by volume of the BCC or BCT matrix phase is present in an acicular phase morphology in the service condition, which develops as a result of a diffusionless phase transformation from the austenitic (face centered cubic, FCC) phase through non-equilibrium accelerated cooling (i.e., quenching). The martensite may or may not be tempered prior to service. The matrix may also contain additional phases in various phase morphologies in the as-quenched condition or after additional heat treatment or heat treatments. Phases such as austenite or ferrite, precipitates such as metal carbides and metal nitrides, and intermetallic compounds such as $Ni_3Mo$, FeTi, and $Fe_2Mo$ may be present. Typical steels falling within the definition used herein include martensitic stainless steels (e.g., M152 and 410), martensitic precipitation hardening stainless steels (e.g., 17-4PH), semi-austenitic precipitation hardening stainless steels (e.g., AM350 and AM355), maraging steels (e.g., Marage 250 and GE1014), and martensitic low alloy steels (e.g., 4340 and 52100).

The nonmetallic precursor compounds may be solid, liquid, or gaseous. In one embodiment, the nonmetallic precursor compounds are preferably solid metallic-oxide precursor compounds. They may instead be vapor-phase reducible nonmetallic compounds of the metallic constituent elements.

The mixture of the nonmetallic precursor compounds may be provided in any operable form. For example, the mixture may be furnished as a compressed mass of particles, powders, or pieces of the nonmetallic precursor compounds, which typically has larger external dimensions than a desired final metallic article. The compressed mass may be formed by pressing and sintering. In another example, the mixture of the nonmetallic precursor compounds may be finely divided particulate or powder, and not compressed to a specific shape. In another example, the mixture may be a mixture of vapors of the precursor compounds.

The step of chemically reducing may produce a sponge of the metallic martensitic steel. It may instead produce finely divided particles of the metallic martensitic steel. The preferred chemical reduction approach utilizes fused salt electrolysis or vapor phase reduction.

Optionally, prior to the step of consolidating, a mixture of the metallic material and an "other additive constituent" may be produced to make the martensitic steel composition.

The step of consolidating may be performed by any operable technique. Preferred techniques are hot isostatic pressing, forging, pressing and sintering, or containerized extrusion of the metallic martensitic steel.

The consolidated metallic article may be used in the as-consolidated form. In appropriate circumstances, it may be formed to other shapes using known forming techniques such as rolling, forging, extrusion, and the like. It may also be post-processed by known techniques such as machining, surface coating, heat treating, and the like.

Several types of solid-state consolidation are practiced in the art. Examples include hot isostatic pressing, pressing plus sintering, canning and extrusion, and forging. However, in all known prior uses of these solid-state consolidation techniques start with metallic material which has been previously melted. The present approach starts with nonmetallic precursor compounds, reduces these precursor compounds and optionally adds other additive elements to the metallic martensitic steel, and consolidates the metallic martensitic steel. There is no melting of the metallic form.

The present approach differs from prior approaches in that the metal is not melted on a gross scale. Melting and its associated processing such as casting are expensive and also produce large-cast-grain-size microstructures and occasionally microstructures with local/long-range segregation such as eutectic nodules, white spots, and freckles that either are unavoidable or can be altered only with additional expensive processing modifications. Undesirable second phases which precipitate in the melt or during solidification of liquid, which are stable and cannot be dissolved in subsequent solid state processing, are avoided. These second phases are a detriment to fatigue strength and/or toughness, and cannot be modified by subsequent processing. However, second phases may be introduced in a more-desirable dispersed form by the present meltless approach. The present approach reduces cost and avoids large grain sizes, detrimental coarse second phases, and imperfections associated with melting and casting, to improve the mechanical properties of the final metallic article. It also results in some cases in an improved ability to fabricate specialized shapes and forms more readily, and to inspect those articles more readily.

Producing a metallic powder or powder-based material such as a sponge without melting avoids a cast structure with its associated imperfections. Those cast-structure imperfections can include elemental segregation (e.g., freckles, white spots, and eutectic nodules) on a nonequilibrium microscopic and macroscopic level, a cast microstructure with a range of grain sizes and morphologies that must be homogenized in some manner for many applications, gas entrapment, and contamination. The powder-based approach herein presented produces a uniform, fine-grained, homogeneous, pore-free, gas-pore-free, and low-contamination final product.

The fine-grain structure of the sponge or powder martensitic steel provides an excellent starting point for subsequent consolidation and metalworking procedures such as forging, hot isostatic pressing, rolling, and extrusion. The finer grain size aids workability because the material moves into a superplastic working range. Conventional cast starting material must be extensively worked to modify and reduce the cast structure, and such extensive working is not necessary with the present approach.

Another important benefit of the present approach is improved inspectability as compared with cast-and-wrought product. Large metallic articles used in fracture-critical applications are inspected multiple times during and at the conclusion of the fabrication processing. Cast-and-wrought product made of metals and used in critical applications such as shafts exhibits a high noise level in ultrasonic inspection due to the microstructure produced during melting, casting, and processing. The presence of this microstructure limits the ability to inspect for small imperfections.

The martensitic steel articles produced by the present approach are of a fine grain size and are free of microstructures discussed previously that inhibit inspectability. As a result, they exhibit a significantly reduced noise level during ultrasonic inspection, and permit inspection for smaller imperfections. The reduction in size of imperfections that may be detected allows larger articles to be fabricated and inspected, thus permitting more economical fabrication procedures to be adopted, and/or the detection of smaller imperfections. By reducing the noise associated with the inspection procedure, larger diameter intermediate-stage articles may be processed and inspected. Processing steps and costs are reduced, and there is greater confidence in the inspected quality of the final product. The final article that contains fewer and smaller imperfections also results in improved mechanical properties.

The present approach is advantageously applied to make martensitic steel articles. Contamination and other impurity elements that are almost unavoidable in conventional casting practice, and which may have major adverse effects on the properties of the material, may be eliminated with the present approach. The structure is more uniform and homogeneous than may be produced by conventional casting and working techniques. For the material produced by the present approach that replaces conventionally cast material, there is a reduced incidence of imperfections such as those produced by segregation and inclusions (e.g., white spots, freckles, eutectic nodules, and banding) during conventional casting operations, and those associated with remelted/recycled material. The cost is also reduced due to the elimination of processing steps associated with casting. The reduction in the cost of the final product achieved by the present approach also makes the martensitic steels more economical. Properties are also improved. Material made by the present approach that is a replacement for conventional wrought articles realizes these same benefits. Additionally, large-sized specialty articles, whose size is limited only by compaction capability, may be made while avoiding microsegregation and macrosegregation. Reduced thermomechanical work is required to produce fine microstructures, and there is reduced loading on the mechanical working equipment. More complex processing may be used, because of the initially fine microstructure.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
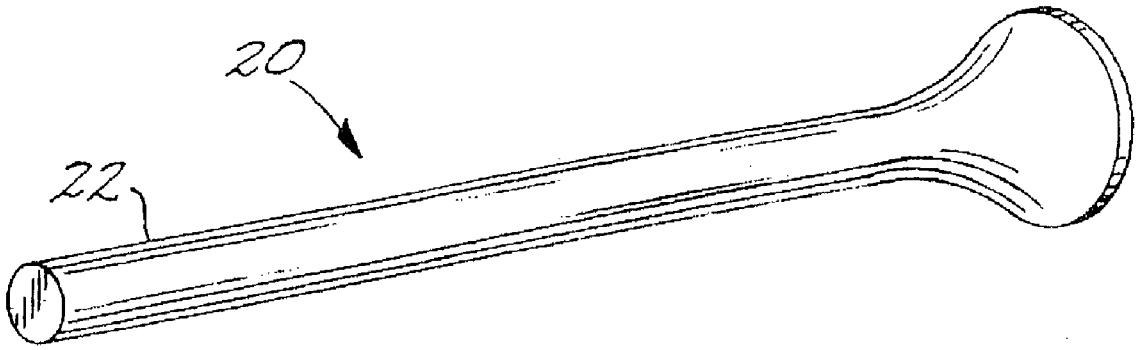
FIG. 1 is a perspective view of a metallic article prepared according to the present approach.

The present approach may be used to make a wide variety of metallic articles 20. An example of interest is a gas turbine engine shaft 22 illustrated in FIG. 1. Some other examples include other gas turbine parts such as disks, blades, vanes, bearing components, rings, cases, and frames; automobile parts; and structural members such as airframe parts. There is no known limitation on the types of articles that may be made by this approach.

Figure 2:
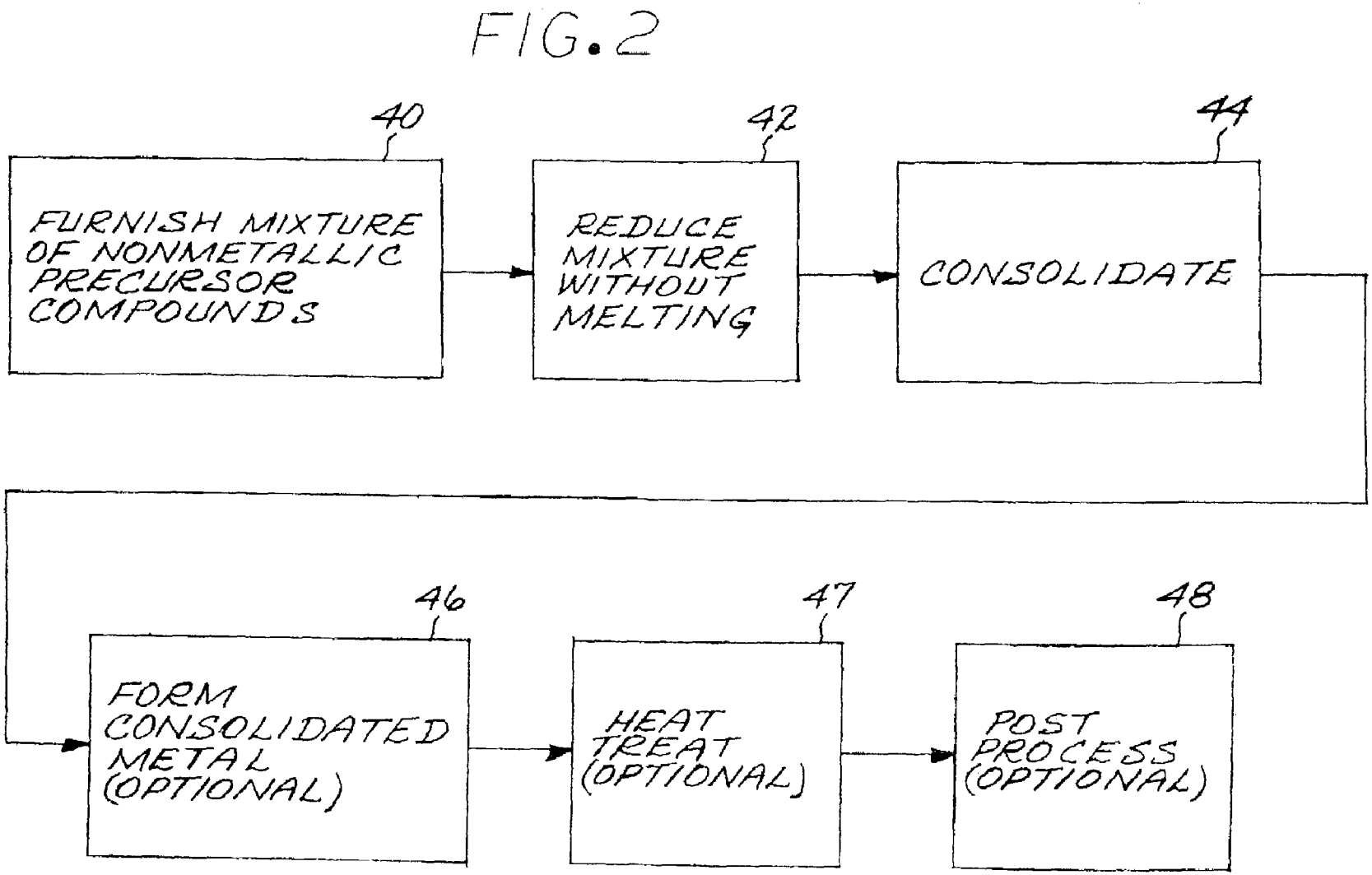
FIG. 2 is a block flow diagram of an approach for practicing the invention.

FIG. 2 illustrates a preferred approach for practicing the invention. The metallic article 20 is fabricated by first furnishing a mixture of nonmetallic precursor compounds of the metallic constituent elements, step 40. "Nonmetallic precursor compounds" are nonmetallic compounds of the metals that eventually constitute the metallic article 20. Any operable nonmetallic precursor compounds may be used. The precursor compounds are nonmetallic and are selected to be operable in the reduction process in which they are reduced to metallic form. In one reduction process of interest, solid-phase reduction, the precursor compounds are preferably metal oxides. In another reduction process of interest, vapor-phase reduction, the precursor compounds are preferably metal halides. Mixtures of different types of precursor compounds may be used, as long as they are operable in the subsequent chemical reduction.

The martensitic-steel composition produced by the present approach is an iron-base alloy. An "iron-base" alloy is defined as having more of the element iron than any other single element, and in many cases has more than 50 percent by weight of iron. The nonmetallic precursor compounds are selected to provide the necessary metals in the final metallic article, and are mixed together in the proper amounts to yield the necessary proportions of these metals in the final metallic article. For example, if the final article were to have composition comparable to that of 17-4PH steel, with a nominal major-element content of 17 weight percent chromium, 4 weight percent nickel, 4 weight percent copper, 0.3 percent niobium, balance iron, the nonmetallic precursor compounds would collectively contain these elements in the ratio of 17 parts chromium to 4 parts nickel to 4 parts copper to 0.3 parts niobium to 74.7 parts iron, by weight. Other minor alloying elements (including carbon) may also be provided in the precursor compounds. The precursor compounds are furnished and mixed together in the correct proportions such that the ratio of the desired elements in the mixture of precursor compounds is that required to form the metallic martensitic steel in the final article. Nonmetallic precursor compounds that serve as a source of more than one of the metals in the final metallic article may also be used. Similar principles apply for other martensitic steels.

The nonmetallic precursor compounds are furnished in any operable physical form. The nonmetallic precursor compounds used in solid-phase reduction are preferably initially in a finely divided form to ensure that they are chemically reacted in the subsequent step. Such finely divided forms include, for example, powder, granules, flakes, or pellets that are readily produced and are commercially available. The nonmetallic precursor compounds in this finely divided form may be processed through the remainder of the procedure described below. In a variation of this approach, the finely divided form of the nonmetallic precursor compounds may be compressed together, as for example by pressing and sintering, to produce a preform that is processed through the remainder of the procedure. In the latter case, the compressed mass of nonmetallic precursor compounds is larger in external dimensions than a desired final metallic article, as the external dimensions are reduced during the subsequent processing.

The mixture of nonmetallic precursor compounds is thereafter chemically reduced by any operable technique to produce a metallic martensitic steel, without melting the metallic martensitic steel, step 42. As used herein, "without melting", "no melting", and related concepts mean that the material is not macroscopically or grossly melted, so that it liquefies and loses its shape. There may be, for example, some minor amount of localized melting as low-melting-point elements melt and are diffusionally alloyed with the higher-melting-point elements that do not melt. Even in such cases, the gross shape of the material remains unchanged.

In one approach, termed solid-phase reduction because the nonmetallic precursor compounds are furnished as solids, the chemical reduction may be performed by fused salt electrolysis. Fused salt electrolysis is a known technique that is described, for example, in published patent application WO 99/64638, whose disclosure is incorporated by reference in its entirety. Briefly, in fused salt electrolysis the mixture of nonmetallic precursor compounds is immersed in an electrolysis cell in a fused salt electrolyte such as a chloride salt at a temperature below the melting temperature of the martensitic steel that forms from the nonmetallic precursor compounds. The mixture of nonmetallic precursor compounds is made the cathode of the electrolysis cell, with an inert anode. The elements combined with the metals in the nonmetallic precursor compounds, such as oxygen in the preferred case of oxide nonmetallic precursor compounds, are removed from the mixture by chemical reduction (i.e., the reverse of chemical oxidation). The reaction is performed at an elevated temperature. The cathodic potential is controlled to ensure that the reduction of the nonmetallic precursor compounds will occur, rather than other possible chemical reactions such as the decomposition of the molten salt. The electrolyte is a salt, preferably a salt that is more stable than the equivalent salt of the metals being refined and ideally very stable to remove the oxygen or other gas to a low level. The chlorides and mixtures of chlorides of barium, calcium, cesium, lithium, strontium, and yttrium are preferred as the molten salt. The chemical reduction may be carried to completion, so that the nonmetallic precursor compounds are completely reduced. Not carrying the process to completion is a method to control the oxygen content of the metal produced.

In another approach, termed vapor-phase reduction because the nonmetallic precursor compounds are furnished as vapors or gaseous phase, the chemical reduction may be performed by reducing mixtures of halides of the base metal and the alloying elements using a liquid alkali metal or a liquid alkaline earth metal. In one embodiment, a mixture of appropriate gases in the appropriate amounts is contacted to molten sodium, so that the metallic halides are reduced to the metallic form. The metallic martensitic steel is separated from the sodium. This reduction is performed at temperatures below the melting point of the metallic martensitic steel, so that the martensitic steel is not melted. The approach is described more fully in U.S. Pat. Nos. 5,779,761 and 5,958,106, whose disclosures are incorporated by reference in their entireties.

In this vapor-phase reduction approach, a nonmetallic modifying element or compound presented in a gaseous form may be mixed into the gaseous nonmetallic precursor compound prior to its reaction with the liquid alkali metal or the liquid alkaline earth metal. In one example, a carbon-containing gas may be mixed with the gaseous nonmetallic precursor compound(s) to increase the level of carbon in the martensitic steel. Similarly, elements such as sulfur, nitrogen, and boron may be added using appropriate gaseous compounds of these elements. Complex combinations of such gaseous elements may be provided and mixed together, such as gaseous compounds of nitrogen, sulfur, carbon, phosphorus, and/or boron, leading to precursor compound phase dissolution of such additive elements or to the formation of chemically more-complex second phases.

Figure 3:
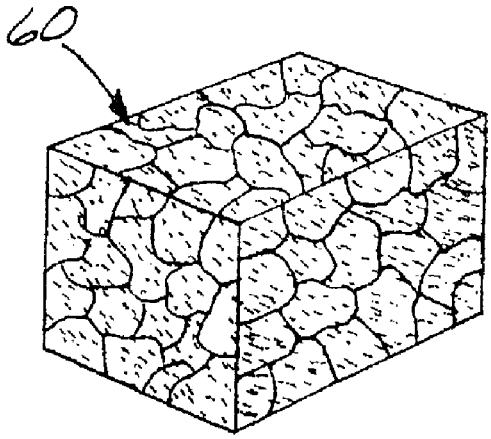
FIG. 3 is a perspective view of a spongy mass of the metallic martensitic steel.

The physical form of the metallic martensitic steel at the completion of step 42 depends upon the physical form of the mixture of nonmetallic precursor compounds at the beginning of step 42. If the mixture of nonmetallic precursor compounds is free-flowing, finely divided solid particles, powders, granules, pieces, or the like, the metallic martensitic steel is also in the same form, except that it is smaller in size and typically somewhat porous. If the mixture of nonmetallic precursor compounds is a compressed mass of the finely divided solid particles, powders, granules, pieces, or the like, then the final physical form of the metallic martensitic steel is typically in the form of a somewhat porous metallic sponge 60, as shown in FIG. 3. The external dimensions of the metallic sponge article are smaller than those of the compressed mass of the nonmetallic precursor compound due to the removal of the oxygen and/or other combined elements in the reduction step 42. If the mixture of nonmetallic precursor compounds is a vapor, then the final physical form of the metallic martensitic steel is typically fine or sponge-like powder that may be further processed.

Some constituents, termed "other additive constituents", may be difficult to introduce into the martensitic steel. For example, suitable nonmetallic precursor compounds of the constituents may not be available, or the available nonmetallic precursor compounds of the other additive constituents may not be readily chemically reducible in a manner or at a temperature consistent with the chemical reduction of other nonmetallic precursor compounds. It may be necessary that such other additive constituents ultimately be present as elements in solid solution in the martensitic steel, as compounds formed by reaction with other constituents of the martensitic steel, or as already-reacted, substantially inert compounds dispersed through the martensitic steel. These other additive constituents or precursors thereof may be introduced from the gas, liquid, or solid phase, as may be appropriate, using one of the four approaches subsequently described or other operable approaches.

In a first approach, the other additive constituents are furnished as elements or compounds and are mixed with the precursor compounds prior to or concurrently with the step of chemically reducing. The mixture of precursor compounds and other additive constituents is subjected to the chemical reduction treatment of step 42, but only the precursor compounds are actually reduced and the other additive constituents are not reduced.

In a second approach, the other additive constituents in the form of solid particles are furnished but are not subjected to the chemical reduction treatment. Instead, they are mixed with the initial metallic material that results from the chemical reduction step, but after the step of chemically reducing 42 is complete. This approach is particularly effective when the step of chemically reducing is performed on a flowing powder of the precursor compounds, but it also may be performed on a pre-compacted mass of the precursor compounds, resulting in a spongy mass of the initial metallic material. The other additive constituents are adhered to the surface of the powder or to the surface of, and into the porosity of, the spongy mass.

In a third approach, the precursor compounds are first produced as powder particles, or as a sponge by compacting the precursor compounds of the metallic elements. The particles are, or the sponge is, then chemically reduced. The other additive constituent is thereafter produced at the surfaces (external and internal, if the particles are spongelike) of the particles, or at the external and internal surfaces of the sponge, from the gaseous phase. In one technique, a gaseous precursor (e.g., methane or nitrogen) is flowed over surface of particle or sponge to deposit the element onto the surface from the gas.

A fourth approach is similar to the third approach, except that the other additive constituent is deposited from a liquid rather than from a gas. The precursor is first produced as powder particles, or as a sponge by compacting the precursor compounds of the metallic elements. The particles are, or the sponge is, then chemically reduced. The other additive constituent is thereafter produced at the surfaces (external and internal, if the particles are spongelike) of the particles, or at the external and internal surfaces of the sponge, by deposition from the liquid. In one technique, the particulate or sponge is dipped into a liquid solution of a precursor compound of the other additive constituent to coat the surfaces of the particles or the sponge. The precursor compound of the other additive constituent is second chemically reacted to leave the other additive constituent at the surfaces of the particles or at the surfaces of the sponge. In an example, lanthanum may be introduced into the martensitic steel by coating the surfaces of the reduced particles or sponge (produced from the precursor compounds) with lanthanum chloride. The coated particles are, or the sponge is, thereafter heated and/or exposed to vacuum to drive off the chlorine, leaving lanthanum at the surfaces of the particles or sponge.

Whatever the reduction technique used in step 42 and however the other additive constituent is introduced, the result is a mixture that comprises the martensitic steel composition. The metallic martensitic steel may be free-flowing particles in some circumstances, or have a sponge-like structure in other cases. The sponge-like structure is produced in the solid-phase reduction approach if the precursor compounds have first been compacted together prior to the commencement of the actual chemical reduction. The precursor compounds may be compressed to form a compressed mass that is larger in dimensions than a desired final metallic article.

The chemical composition of the metallic martensitic steel is determined by the types and cumulative amounts of the metals in the mixture of nonmetallic precursor compounds furnished in step 40 or added during processing.

The metallic martensitic steel is in a form that is not structurally useful for most applications. Accordingly, the metallic martensitic steel is thereafter consolidated to produce a consolidated metallic article, without melting the metallic martensitic steel and without melting the consolidated metallic article, step 44. The consolidation removes porosity from the metallic martensitic steel, desirably increasing its relative density to or near 100 percent. Any operable type of consolidation may be used. Preferably, the consolidation 44 is performed by hot isostatic pressing the metallic martensitic steel under appropriate conditions of temperature and pressure, but at a temperature less than the melting points of the metallic martensitic steel and the consolidated metallic article (which melting points are typically the same or very close together). Pressing and solid-state sintering or extrusion of a canned material may also be used, particularly where the martensitic steel is in the form of a powder. The consolidation reduces the external dimensions of the mass of metallic martensitic steel, but such reduction in dimensions is predictable with experience for particular compositions. The consolidation processing 44 may also be used to achieve further alloying of the metallic article with alloying elements such as nitrogen.

The consolidated metallic article may be used in its as-consolidated form. Instead, in appropriate cases the consolidated metallic article may optionally be formed, step 46, by any operable metallic forming process, as by forging, extrusion, rolling, and the like. Some metallic compositions are amenable to such forming operations, and others are not. However, the martensitic steel article consolidated by the present approach will be much more amenable to forming operations than its equivalent conventionally prepared (i.e., cast or cast-and-wrought) composition due to its finer grain size and potential for superplastic forming.

The consolidated metallic article is thereafter optionally but preferably heat treated to produce an acicular phase morphology characteristic of a martensitic microstructure, step 47. Such heat treatments are known in the art for the various compositions produced by other techniques, but generally involve heating above a required temperature, known for each composition, and then a relatively rapid cooling (i.e., quenching) to produce the martensitic structure. Step 47 may be performed at this point in the processing, after any post-processing, or between individual post-processing procedures.

The consolidated metallic article may also be optionally post-processed by any operable approach, step 48. Such post-processing steps may include, for example, heat treating such as tempering, surface coating, machining, and the like. The steps 46 and 48 may be performed in the indicated order, or step 48 may be performed prior to step 46. Thus, steps 46, 47, and 48 may be performed in any operable sequence.

The martensitic steel is never heated above its melting point. Additionally, it may be maintained below specific temperatures that are themselves below the melting point, such as various precipitate (e.g., non-metallic particles such as carbides, or intermetallic particles) solvus temperatures. Such temperatures are known in the art for the specific compositions.

In other cases, it is desirable to heat the martensitic steel above a particular solvus temperature in order to achieve a specific type of microstructure. Such temperatures are known in the art for the specific compositions.

The present approach processes the mixture of nonmetallic precursor compounds to a finished metallic form without the metal of the finished metallic form ever being heated above its melting point. Consequently, the process avoids the costs associated with melting operations, such as controlled-atmosphere or vacuum furnace costs. The microstructures associated with melting, typically large-grained structures, casting imperfections, and segregation-related imperfections (e.g., freckles, white spots, and eutectic nodules), are avoided. Without such imperfections, the reliability or the articles is improved. The greater confidence in the substantially imperfection-free state of the article, achieved with the better inspectability discussed above, also leads to a reduction in the extra material that must otherwise be present. Mechanical properties such as static strength, fatigue strength, and toughness may be improved, potentially allowing the articles to be lighter in weight. Inspectability is improved, and the product has reduced cost, imperfections, and porosity, as compared with the product of other powder metallurgy processing.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for fabricating a metallic article made of metallic constituent elements, comprising the steps of furnishing a mixture of nonmetallic precursor compounds of the metallic constituent elements;

chemically reducing the mixture of nonmetallic precursor compounds to produce a metallic iron-base alloy, without melting the metallic iron-base alloy, wherein the step of chemically reducing includes the step of chemically reducing the mixture of nonmetallic precursor compounds by solid-phase reduction and consolidating the metallic iron-base alloy to produce a consolidated metallic article, without melting the metallic iron-base alloy and without melting the consolidated metallic article; and heat treating the consolidated metallic article to produce a continuous body-centered cubic or body-centered tetragonal crystal structure matrix phase in the iron-base alloy, wherein at least about 75 percent by volume of the body-centered cubic or body-centered tetragonal matrix phase is present in an acicular phase morphology, wherein the step of chemically reducing includes the step of producing a sponge of the metallic iron-base alloy.

2. The method of claim 1, wherein the step of furnishing the mixture includes the step of furnishing a compressed mass of the nonmetallic precursor compounds.

3. The method of claim 1, wherein the step of furnishing the mixture includes the step of furnishing a compressed mass of the nonmetallic precursor compounds larger in dimensions than the consolidated metallic article.

4. The method of claim 1, wherein the step of furnishing the mixture includes the step of furnishing the mixture comprising metallic-oxide precursor compounds.

5. A method for fabricating a metallic article made of metallic constituent elements, comprising the steps of furnishing a mixture of nonmetallic precursor compounds of the metallic constituent elements;

chemically reducing the mixture of nonmetallic precursor compounds to produce a metallic iron-base alloy, without melting the metallic iron-base alloy, wherein the step of chemically reducing includes the step of chemically reducing the mixture of nonmetallic precursor compounds by vapor-phase reduction; and consolidating the metallic iron-base alloy to produce a consolidated metallic article, without melting the metallic iron-base alloy and without melting the consolidated metallic article; and heat treating the consolidated metallic article to produce a continuous body-centered cubic or body-centered tetragonal crystal structure matrix phase in the iron-base alloy, wherein at least about 75 percent by volume of the body-centered cubic or body-centered tetragonal matrix phase is present in an acicular phase morphology.

6. The method of claim 5, wherein the step of famishing the mixture includes the step of furnishing the mixture comprising metal halide precursor compounds.

7. The method of claim 5, including an additional step, performed prior to the step of chemically reducing, of mixing a gaseous modifier comprising a modifying element into the mixture of nonmetallic precursor compounds.

8. The method of claim 1, including an additional step, performed prior to the step of consolidating, of producing a mixture of a metallic material and an other additive constituent that together have the composition of the metallic iron-base alloy.

9. The method of claim 1, wherein the step of consolidating includes the step of consolidating the metallic iron-base alloy using a technique selected from the group consisting of hot isostatic pressing, forging, pressing and sintering, and contained extrusion.

10. The method of claim 1, including an additional step, after the step of consolidating, of forming the consolidated metallic article.

11. The method of claim 1, wherein the step of consolidating includes the step of consolidating the metallic iron-base alloy to produce a gas turbine component.

12. The method of claim 1, including an additional step, performed after the step of consolidating, of post-processing the consolidated metallic article.

13. The method of claim 1, wherein the step of furnishing includes the step of furnishing a mixture having a net composition of a martensitic stainless steel, a martensitic precipitation hardening stainless steel, a semiaustenitic precipitation hardening stainless steel, a maraging steel, or a martensitic low alloy steel.

14. The method of claim 5, including an additional step, performed prior to the step of consolidating, of producing a mixture of a metallic material and an other additive constituent that together have the composition of the metallic iron-base alloy.

15. The method of claim 5, wherein the step of furnishing includes the step of furnishing a mixture having a net composition of a martensitic stainless steel, a martensitic precipitation hardening stainless steel, a semiaustenitic precipitation hardening stainless steel, a maraging steel, or a martensitic low alloy steel.

16. A method for fabricating a metallic article made of metallic constituent elements, comprising the steps of furnishing a mixture of nonmetallic precursor compounds of the metallic constituent elements;

chemically reducing the mixture of nonmetallic precursor compounds to produce a metallic iron-base alloy, without melting the metallic iron-base alloy; and consolidating the metallic iron-base alloy to produce a consolidated metallic article, without melting the metallic iron-base alloy and without melting the consolidated metallic article; and heat treating the consolidated metallic article to produce a continuous body-centered cubic or body-centered tetragonal crystal structure matrix phase in the iron-base alloy, wherein at least about 75 percent by volume of the body-centered cubic or body-centered tetragonal matrix phase is present in an acicular phase morphology, wherein the step of chemically reducing includes the step of producing a sponge of the metallic iron-base alloy.

* * * * *